US005198866A

United States Patent [19]

Kimura et al.

[11] Patent Number: 5,198,866

[45] Date of Patent: Mar. 30, 1993

[54] ROTARY DEVELOPING DEVICE HAVING ADJUSTABLE DEVELOPING UNITS FOR IMAGE FORMING EQUIPMENT

[75] Inventors: Noriyuki Kimura, Kawasaki; Minoru Suzuki, Yokohama, both of Japan

[73] Assignee: Ricoh Company, Ltd., Tokyo, Japan

[21] Appl. No.: 827,593

[22] Filed: Jan. 29, 1992

[30] Foreign Application Priority Data

Jan. 29, 1991 [JP] Japan ..... 3-29314

[51] Int. Cl.[5] ..... G03G 15/01

[52] U.S. Cl. ..... 355/326; 118/645; 355/245

[58] Field of Search ..... 355/245, 326, 327; 118/645, 653

[56] References Cited

U.S. PATENT DOCUMENTS

| | | | |
|---|---|---|---|
| 4,622,916 | 11/1986 | Tanaka et al. | 118/645 X |
| 4,743,938 | 5/1988 | Ohno | 118/645 X |
| 4,772,913 | 9/1988 | Watanabe | 355/326 |
| 4,922,301 | 5/1990 | Katoh et al. | 355/326 X |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A rotary developing device incorporated in image forming equipment has a plurality of developing units rotatably mounted on a rotary shaft and rotating the developing units for sequentially developing latent images electrostatically formed on an image carrier at a developing position where the developing units sequentially face the image carrier. First side plates are formed integrally at least with the rotary shaft. Partitions extend radially away from said rotary shaft for separating said developing units from one another. Second side plates are respectively removably mounted on the first side plates. At least a developer carrier included in each of the developing units and a member also included in the developing unit and contacting or adjoining the developer carrier in a predetermined positional relation are mounted on the second side plates.

4 Claims, 4 Drawing Sheets

ROTARY DEVELOPING DEVICE HAVING ADJUSTABLE DEVELOPING UNITS FOR IMAGE FORMING EQUIPMENT

BACKGROUND OF THE INVENTION

The present invention relates to a rotary developing device incorporated in image forming equipment and having a plurality of developing units rotatably mounted on a rotary shaft and rotating the developing units for sequentially developing latent images electrostatically formed on an image carrier at a developing position where the developing units sequentially face the image carrier.

One of conventional image forming equipment exposes a photoconductive element or similar image carrier by imagewise light undergone color separation to electrostatically form latent images, develops each of the latent images by a toner of particular color complementary to the imagewise light, and transfers the resulting toner images one above another to a single paper sheet. Another conventional image forming equipment electrostatically forms latent images of a single image which should be rendered in different colors on respective image carriers, develops the latent images by toners of different colors, and transfers the resulting toner images one above another to a single paper sheet. Such image forming equipment, whether it be of the first-mentioned type or of the second mentioned type, needs a plurality of developing units, i.e., a plurality of developing units should be constructed independently of one another and juxtaposed in the vicinity of the image carrier, resulting in a bulky construction.

To eliminate the above problem, a rotary developing device having a plurality of developing units rotatably mounted on a rotary shaft has been proposed. This type of developing device rotates the developing units for sequentially developing latent images electrostatically formed on an image carrier at a developing position where the developing units sequentially face the image carrier. For example, Japanese Patent Laid-Open Publication No. 172660/1983 discloses a developing device having partitions extending radially away from a rotary shaft to divide the space between two side plates of the device into a plurality of developing chambers. Japanese Patent Laid-Open Publication No. 73163/1986 teaches a developing device having a plurality of developing units which are removably mounted on a common support body having a center shaft. These conventional developing devices, however, have various problems left unsolved, as follows.

The developing device taught in the first-mentioned Laid-Open Publication has developing rollers and other components of the developing units mounted on the side plates of the device independently of one another. This not only makes it difficult to assemble the components but also complicates the replacement of the developing rollers and blades which regulate the thickness of developer layers deposited on the developing rollers. Moreover, the position or the distance of each developing roller from the image carrier or the rotary shaft or the contact pressure exerted by the former on the latter is determined solely by the accuracy of parts constituting the side plates of the device. Therefore, once the distance, for example, between any developing roller and the image carrier is deviated from predetermined one, the image density will become insufficient or become irregular in the lengthwise direction of the roller.

In this manner, since each developing roller, for example, cannot be adjusted in position relative to the image carrier, the parts and elements constituting the developing device should be machined with utmost accuracy and are, therefore, expensive.

On the other hand, the developing device disclosed in the second-mentioned Laid-Open Publication allows the distance, for example, between each developing roller and the image carrier to be adjusted since the developing units are provided independently of one another. However, such a developing device is more bulky and heavier than the developing device of the first-mentioned Laid-Open Publication and needs a greater number of parts, again resulting in an expensive construction. In addition, when only the position of any developing unit is adjusted, a gear train for transmitting a driving force to the developing unit is brought out of accurate meshing.

SUMMARY OF THE INVENTION

It is, therefore, an object of the present invention to provide a rotary developing device for image forming equipment which allows component parts thereof to be assembled and replaced with ease and allows them to be adjusted in position, as needed.

It is another object of the present invention to provide a small and inexpensive rotary developing device for image forming equipment.

A rotary developing device incorporated in image forming equipment and having a plurality of developing units rotatably mounted on a rotary shaft and rotating the developing units for sequentially developing latent images electrostatically formed on an image carrier at a developing position where the developing units sequentially face the image carrier of the present invention comprises first side plates formed integrally at least with the rotary shaft, partitions extending radially away from the rotary shaft for separating the developing units from one another, and second side plates respectively removably mounted on the first side plates. At least a developer carrier included in each of the developing units and a member also included in the developing unit and contacting or adjoining the developer carrier in a predetermined positional relation are mounted on the second side plates.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
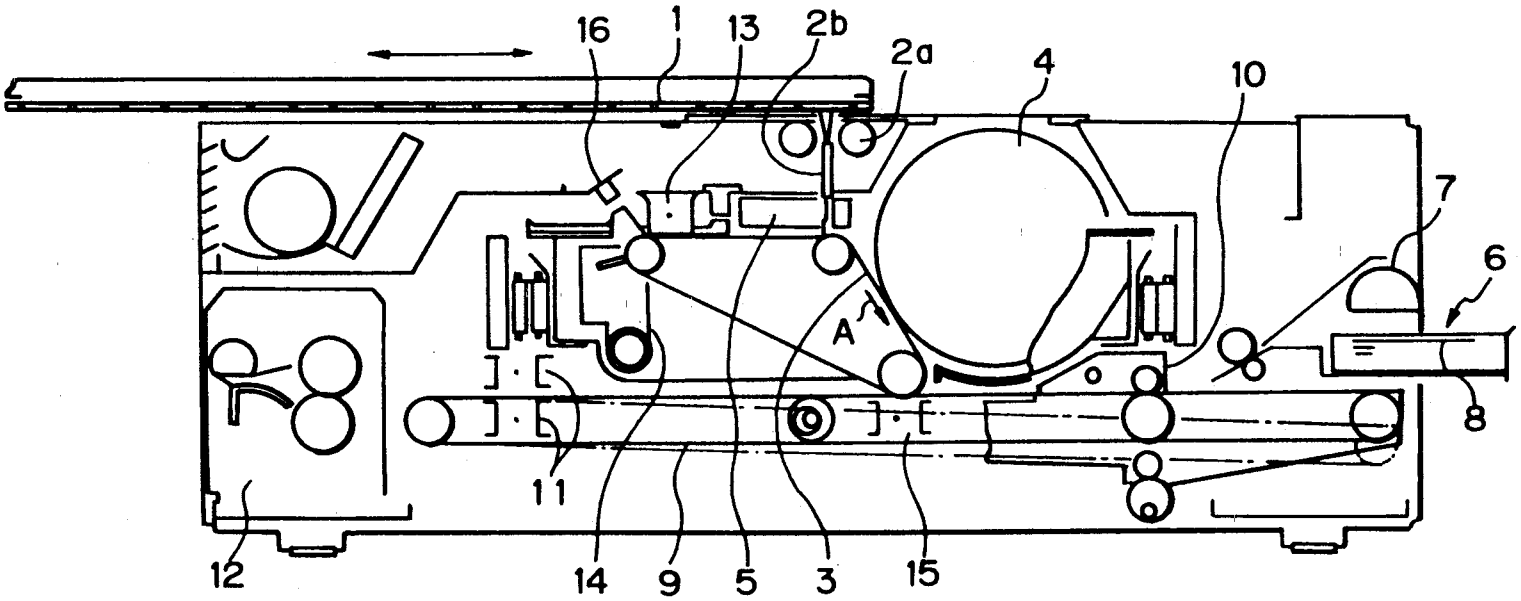
FIG. 1 is a section of image forming equipment implemented as a full color copier and including a rotary developing device embodying the present invention.

Referring to FIG. 1 of the drawings, image forming equipment including a rotary developing device embodying the present invention is shown and implemented as a full color copier. As shown, the full color copier has a carriage 1 on which a document is laid. The carriage 1 carrying the document thereon is movable in a reciprocating motion in the right-and-left direction as viewed in the figure. A lamp 2*a* illuminates the document being moved by the carriage 1 at a predetermined position through a slit. The resulting reflection from the document is focused by a rod lens array 2*b* onto a photoconductive belt, or image carrier, 3. The carriage 1 and the photoconductive belt 3 are moved in synchronism with each other by a drive mechanism, not shown. As a result, a latent image representative of the document is electrostatically formed on the surface of the belt 3 which has been uniformly charged by a charger 13.

A rotary developing device 4 embodying the present invention, a transfer charger 15, a cleaning device 14 and a discharge lamp 16 are sequentially arranged round the belt 3 in this order in a direction indicated by an arrow A in FIG. 1. A blue filter, a green filter and a red filter, labeled 5 collectively, are selectively brought into an optical path for exposure, one at a time. The latent image formed on the belt 3 via any one of the filters 5 is developed by the developing device 4. The developing device 4 has three developing units, i.e., a yellow developing unit 22Y storing a yellow toner, a magenta developing unit 22M storing a magenta toner, and a cyan developing unit 22C storing a cyan toner, as will be described later specifically (see FIG. 2). A transport belt 9 surrounds the transfer charger 15 and adjoins the image transfer portion of the photoconductive belt 3. As a paper sheet 8 is fed from a paper tray 6 to the transport belt 9 via a pick-up roller 7 and a register roller pair 10, the belt 9 moves the paper sheet 8 in a linear reciprocating motion in the horizontal direction as viewed in FIG. 1. As a result, toner images of three different colors formed on the belt 3 are transferred one above another to the same paper sheet 8. The paper sheet 8 carrying the resulting composite color image has the charge thereof dissipated by a discharger 11 together with the belt 9 to be thereby separated from the belt 9. Subsequently, a fixing device 11 fixes the toner image on the paper sheet to produce a full color copy.

Figure 2:
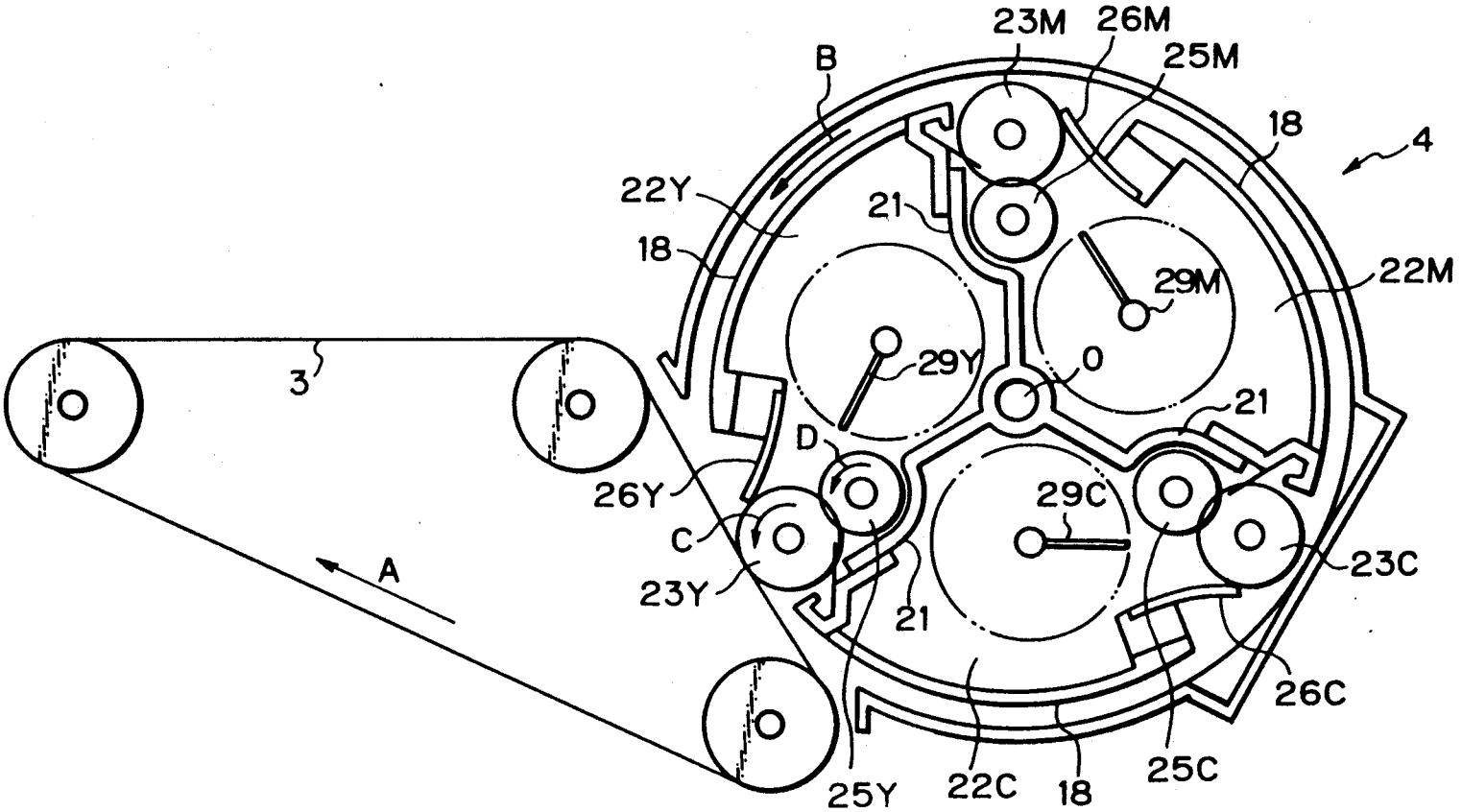
FIG. 2 is a section of the developing device shown in FIG. 1.

As shown in FIG. 2, the rotary developing device 4 has a hollow cylindrical casing 18 which is rotatable about a rotary shaft O. The casing 18 is driven in a direction indicated by an arrow B in the figure by a drive mechanism, not shown. The previously mentioned yellow developing unit 22Y, magenta developing unit 22M and cyan developing unit 22C are accommodated in the casing 18. Specifically, three partitions 21 extend radially away from the shaft O to form the three developing units 22Y, 22M and 22C. FIG. 2 shows a specific condition wherein the yellow developing unit 22Y is brought to the developing position. The developing units 22Y, 22M and 22C have respectively developer carriers in the form of developing rollers 23Y, 23M and 23C each playing the role of a developer carrier and transporting the associated toner to the photoconductive belt 3. The developing rollers 23Y, 23M and 23C each partly protrudes to the outside of the casing 18 via an opening formed through the casing 18. The developing rollers 23Y, 23M and 23C are rotated in a direction indicated by an arrow C in the figure by a drive mechanism which will be described.

In the illustrative embodiment, the developing device 4 is implemented with nonmagnetic one-component developers. The developing units 22Y, 22M and 22C are rotated about the shaft O until desired one of them reaches the developing position. While the developing roller 23Y, 23M or 23C disposed in the desired developing unit is rotated, it develops a latent image formed on the belt 3 by the yellow, magenta or cyan toner stored in the developing unit. As such an operation is repeated, the resulting images of three different colors are transferred one above another to the paper sheet 8 to complete a full color copy.

The developing units 22Y, 22M and 22C have other members, i.e., respectively supply rollers 25Y, 25M and 25C, elastic blades 26Y, 26M and 26C, and agitators 29Y, 29M and 29C in addition to the developing rollers 23Y, 23M and 23C. The supply rollers 25Y, 25M and 25C each comprises a cylindrical elastic roller made of, for example, foam polyurethane and are rotatable in a direction D, FIG. 2, driven by the drive mechanism which will be described. Since the supply rollers 25Y, 25M and 25C are respectively held in pressing contact with the developing rollers 23Y, 23M and 23C, they frictionally charge the respective toners and supply them to the respective developing rollers 23Y, 23M and 23C. The elastic blades 26Y, 26M and 26C are implemented as strips made of urethane rubber or similar elastic substance. The blades 26Y, 26M and 26C are each held in pressing contact with part of the associated one of the developing rollers 23Y, 23M and 23C downstream of the supply roller 25Y, 25M or 25C, thereby regulating the thickness of the toner layers deposited on the respective developing rollers 23Y, 23M and 23C. The agitators 29Y, 29M and 29C are rotated at suitable timings by a drive mechanism, not shown, so as to agitate the toners stored in the respective developing units 22Y, 22M and 22C.

Figure 3:
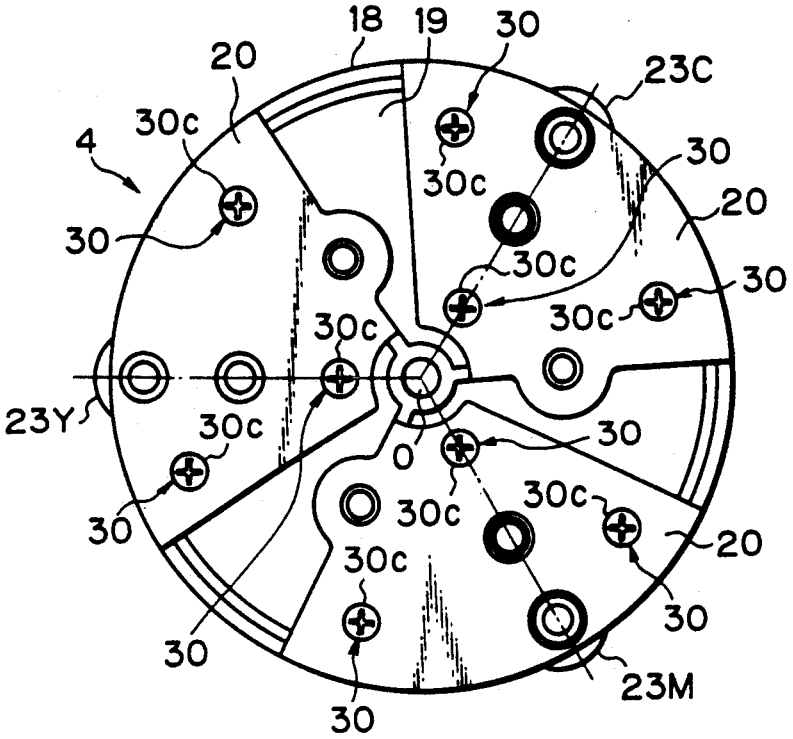
FIG. 3 is a side elevation of side plates included in the developing device of FIG. 1.
Figure 4:
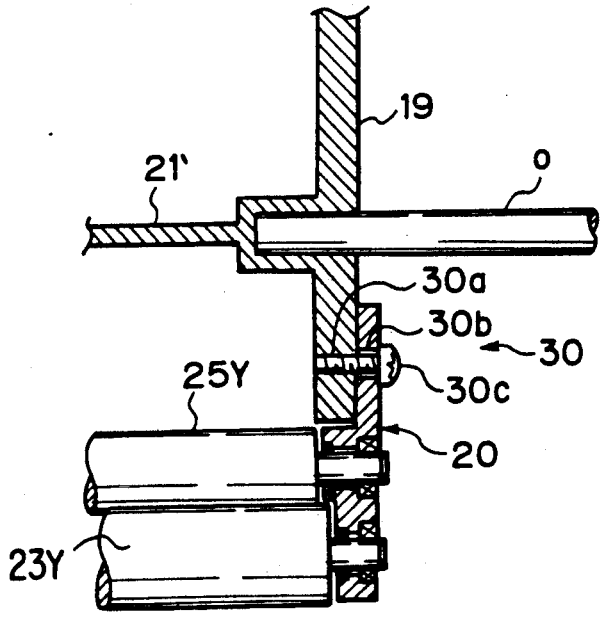
FIG. 4 is a section of the side plates.
Figure 5:
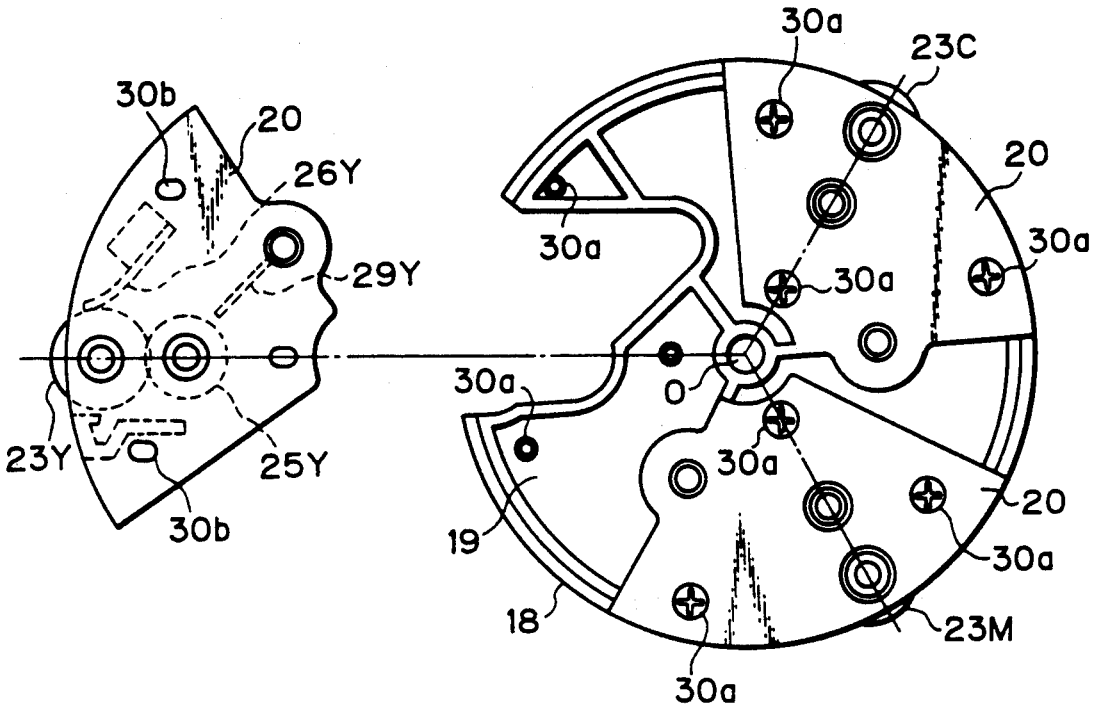
FIG. 5 is a side elevation showing how second side plates may be attached to and detached from first side plates.
Figure 6:
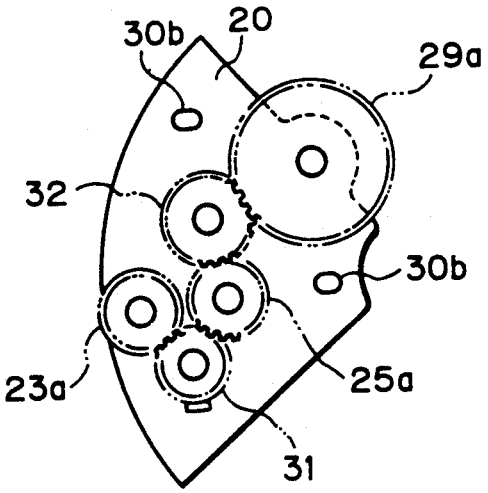
FIG. 6 is a view of one of the second side plates.

As shown in FIGS. 3 and 4, each of the radially extending partitions 21 has a first side plate 19 at both ends thereof. The first side plate 19 is formed integrally with the shaft O and partition 21, as illustrated. A second side plate 20 is located outside of each first side plate 19 and removably affixed to the first side plate 19 by fastening members 30. As shown in FIGS. 4 and 5, the fastening members 30 fastening the respective second side plates 20 to the respective first side plates 19 are implemented by threaded holes 30*a* formed through the first side plates 19, elongate slots 30*b* formed through the second side plates 20 to align with the theaded holes 30*a*, and screws 30*c* driven into the threaded holes 30*a* through the slots 30*b*.

As shown in FIG. 5, the slots 30*b* are each so configured as to extend parallel to the radial direction of the associated developing unit with respect to the shaft O. The second side plate 20, therefore, can have the position thereof adjusted in the radial direction relative to the associated first side plate 19. As FIG. 5 indicates, the developing units 22Y, 22M and 22C, developing rollers 23Y, 23M and 23C, and the other members, i.e., the supply rollers 25Y, 25M and 25C, elastic blades 26Y, 26M and 26C, and agitators 29Y, 29M and 29C are mounted on the respective second side plates 20. Therefore, the positional relation of the component parts of the respective developing units to one another is determined and maintained by the second side plates 20.

In the above configuration, the distance or the contact pressure between the photoconductive belt 3 and each of the developing rollers 23Y, 23M and 23C, i.e., the positional relation between the shaft O and each developing roller can be readily adjusted if the position of the second side plate 20 relative to the first side plate is adjusted. Such adjustment may be effected when the developing device 4 is assembled or when the developing device 4 is mounted on the body of image forming equipment.

The parts and elements constituting each developing unit are positioned relative to one another by the second side plate 20, as stated earlier. Hence, even when the second side plate 20 is displaced relative to the associated first side plate 19 in the event of adjustment, it does not effect the relative position, adjustment condition or similar factor of the associated developing roller 23Y, 23M or 23C, and other members, i.e. supply roller 25Y, 25M and 25C, blade 26Y, 26M or 26C, and agitator 29Y, 29M or 29C.

As shown in FIG. 5, the developing rollers 23Y, 23M and 23C, supply rollers 25Y, 25M and 25C, blades 26Y, 26M and 26C, and agitators 29Y, 29M and 29C are mounted on the respective second side plates 20 in a predetermined relative position, constituting respective developing units. Each of such developing units including the second side plates 20 is removably mounted on the associated first side plates 19 while being oriented in the radial direction with respect to the shaft O. The developing device 4, therefore, is easy to assemble and can have the parts and elements thereof replaced with ease.

Further, in the illustrative embodiment, a gear train including gears 23*a*, 25*a* and 29*a* for driving the developing roller, supply roller and agitator, respectively, and intermediate gears 31 and 32 is mounted on each second side plate 20 to serve as a drive mechanism. In this configuration, the relative position of the gears constituting each gear train is not effected when the position of the associated developing unit is adjusted, eliminating incomplete drive and noise ascribable to incomplete meshing.

As stated above, the illustrative embodiment allows the developing units to be readily put in optimal image forming conditions only if the second side plates are adjusted in position relative to the respective first side plates. This is successful in readily enhancing the quality of images.

In summary, in accordance with the present invention, a rotary developing device has second side plates which are removably mounted on first side plates including a rotary shaft. The developing device is, therefore, small size, inexpensive, and easy to assemble, replace parts and elements, and maintain. Since a developing roller and other members such as a supply roller, blade and other components which should be accurately positioned relative to the developing roller are mounted on the second side plates, their predetermined relative position is insured.

The second side plates can be adjusted relative to and affixed to the first side plates while carrying the developing roller therewith. This is successful in setting up an adequate gap or the contact pressure between the developing roller and an image carrier, i.e., an adequate relation between the rotary shaft and the developing roller which has critical influence on the image quality.

Moreover, in accordance with the present invention, a gear train for transmitting a driving force to or from the developing roller is mounted on the second side plates. Therefore, gear elements constituting the gear train are held in a predetermined meshing relation despite the adjustment of the associated developing unit, eliminating incomplete drive and noise ascribable to incomplete meshing.

Various modifications will become possible for those skilled in the art after receiving the teachings of the present disclosure without departing from the scope thereof.

What is claimed is:

1. A rotary developing device incorporated in image forming equipment and having a plurality of developing units rotatably mounted on a rotary shaft and rotating said developing units for sequentially developing latent images electrostatically formed on an image carrier at a developing position where said developing units sequentially face said image carrier, said device comprising:

first side plates formed integrally at least with said rotary shaft;

partitions extending radially away from said rotary shaft for separating said developing units from one another; and second side plates respectively removably mounted on said first side plates;

at least a developer carrier included in each of said developing units and a member also included in said developing units and contacting or adjoining said developer carrier in a predetermined positional relation being mounted on said second side plates.

2. A device as claimed in claim 1, further comprising fastening means for mounting said second side plates carrying at least said developer carrier on said first side plates while allowing said second side plates to be displaced in a radial direction toward or away from said rotary shaft.

3. A device as claimed in claim 2, further comprising drive transmitting means mounted on said second side plates for transmitting a driving force to or from said developer carrier.

4. A device as claimed in claim 3, wherein said drive transmitting means comprises a gear train adjoining a shaft on which said developer carrier is mounted.

* * * * *